US008087874B2

(12) United States Patent
Jardine et al.

(10) Patent No.: US 8,087,874 B2
(45) Date of Patent: Jan. 3, 2012

(54) RETENTION STRUCTURES AND EXIT GUIDE VANE ASSEMBLIES

(75) Inventors: Brian Jardine, Scottsdale, AZ (US); Brian Koch, Chandler, AZ (US); Jeff Guymon, Gilbert, AZ (US); Craig White, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 498 days.

(21) Appl. No.: 12/394,588

(22) Filed: Feb. 27, 2009

(65) Prior Publication Data

US 2010/0221115 A1 Sep. 2, 2010

(51) Int. Cl.
*F01D 5/30* (2006.01)

(52) U.S. Cl. ... 415/9; 415/209.2; 415/209.4; 415/210.1; 415/189; 415/190

(58) Field of Classification Search ..... 415/9, 209.2–209.4, 210.1, 189, 415/190

See application file for complete search history.

(56) References Cited

U.S. PATENT DOCUMENTS

| | | | | |
|---|---|---|---|---|
| 4,474,346 | A * | 10/1984 | Murphy et al. | 244/54 |
| 4,503,667 | A * | 3/1985 | Roberts | 60/39.091 |
| 6,533,550 | B1 | 3/2003 | Mills | |
| 6,595,755 | B2 | 7/2003 | Brioude et al. | |
| 6,764,282 | B2 | 7/2004 | Suciu et al. | |
| 7,309,215 | B2 | 12/2007 | Negulescu | |
| 2007/0059158 | A1 | 3/2007 | Alvanos et al. | |
| 2010/0163671 | A1 * | 7/2010 | Svensson et al. | 244/54 |

* cited by examiner

*Primary Examiner* — Gary F. Paumen
(74) *Attorney, Agent, or Firm* — Ingrassia Fisher & Lorenz, P.C.

(57) ABSTRACT

A retention structure includes a center body including an outer surface, an enclosed end, an open end, and a contact section, the outer surface adapted to define a first portion of a flowpath, and the contact section extending radially outwardly from a centerline and located on the enclosed end and configured to reduce a radial and a torsional component of a first load that exceeds a first threshold applied to the contact section, when the turbine rotates and applies the first load to the contact section and an energy absorber coupled to the center body, disposed adjacent to the contact section, and having an outer surface adapted to define a second portion of the flowpath, the energy absorber further adapted to collapse, when the turbine rotates and contacts the energy absorber and applies a second load that exceeds a second threshold to the energy absorber.

18 Claims, 4 Drawing Sheets

RETENTION STRUCTURES AND EXIT GUIDE VANE ASSEMBLIES

TECHNICAL FIELD

The inventive subject matter generally relates to turbine engines, and more particularly relates to retention structures for use in retaining turbines of turbine engines.

BACKGROUND

A turboshaft turbine engine may be used to power various components of an aircraft, such as a propeller of a helicopter or a turboprop airplane. Typically, the turboshaft turbine engine includes, for example, an intake section, a compressor section, a combustor section, and a turbine section, and each section may include one or more components mounted to a common shaft. The turboshaft turbine engine may also include an exhaust section that is located downstream from the turbine section.

Generally, the intake section induces air from the surrounding environment into the engine and accelerates the air toward the compressor section. The compressor section, which may include one or more compressors, raises the pressure of the air it receives from the intake section to a relatively high level. The compressed air then enters the combustor section, where a ring of fuel nozzles injects a steady stream of fuel into a plenum. The injected fuel is ignited to produce high-energy compressed air. The air then flows into and through the turbine section to impinge upon turbine blades therein to rotate the shaft. The shaft may be coupled to a propeller or other component, with or without an intervening speed reduction gearbox, and may provide energy for propulsion thereof. The air exiting the turbine section may be exhausted from the engine via the exhaust section.

At times, the engine may experience a loss of load absorption, which may lead to an overspeed condition. In such case, airflow from the combustor section may produce a load upon a turbine that could accelerate the turbine beyond a predetermined maximum operating speed. To minimize the magnitude of the overspeed condition, an electrical system coupled to the engine may cease supplying fuel to the combustor section to decrease the energy and to slow the velocity of the airflow therefrom. Although the aforementioned types of systems are adequate for minimizing overspeed, additional or alternative means of preventing damage to adjacent components during the overspeed condition, if it should occur, may be desired in some circumstances.

Accordingly, it is desirable to include a structure or apparatus in a turbine engine that may be used to prevent damage to adjacent components during an overspeed condition. In addition, it is desirable for the structure or apparatus to be capable of being retrofitted into existing turbine engines and to be relatively simple and inexpensive to manufacture. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Retention structions and exit guide vane assemblies are provided.

In an embodiment, by way of example only, a retention structure for retaining an adjacent turbine, where the turbine capable of rotating about a centerline, is provided. The retention structure includes a center body extending along the centerline and including an outer surface, an enclosed end, an open end, and a contact section, the outer surface adapted to define a first portion of a flowpath, and the contact section extending radially outwardly from the centerline and located on the enclosed end of the center body, the contact section configured to reduce a radial component and a torsional component of a first load that exceeds a first threshold applied to the contact section, when the turbine rotates and contacts the contact section and applies the first load to the contact section and an energy absorber coupled to the center body and disposed adjacent to the contact section, the energy absorber having an outer surface adapted to define a second portion of the flowpath, the energy absorber further adapted to collapse, when the turbine rotates and contacts the energy absorber and applies a second load that exceeds a second threshold to the energy absorber.

In another embodiment, by way of example only, an exit guide vane assembly includes a center body, a baffle, an annular case, and a plurality of vanes. The center body extends along a centerline and includes an enclosed end, an open end, and a midsection. The enclosed end is defined by a contact section and an angled section, the contact section extends radially outwardly relative to the centerline, and the angled section is angled relative to the contact section and extends from the contact section to the midsection. The baffle is disposed around the enclosed end of the center body and includes a radial section and an axial section. The radial section extends radially outwardly and is angled relative to the contact section of the center body, and the axial section is angled relative to the radial section and is disposed around the angled section of the center body to extend toward the center body. The annular case is disposed radially outwardly relative to the center body. The plurality of vanes extends between the center body and the annular case. The baffle is configured to collapse, when an adjacent rotating turbine applies a first load that exceeds a first threshold against the baffle, and the center body is configured to reduce a radial component and a torsional component of a second load that exceeds a second threshold, when the adjacent rotating turbine applies the second load against the contact section of the center body.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Figure 1:
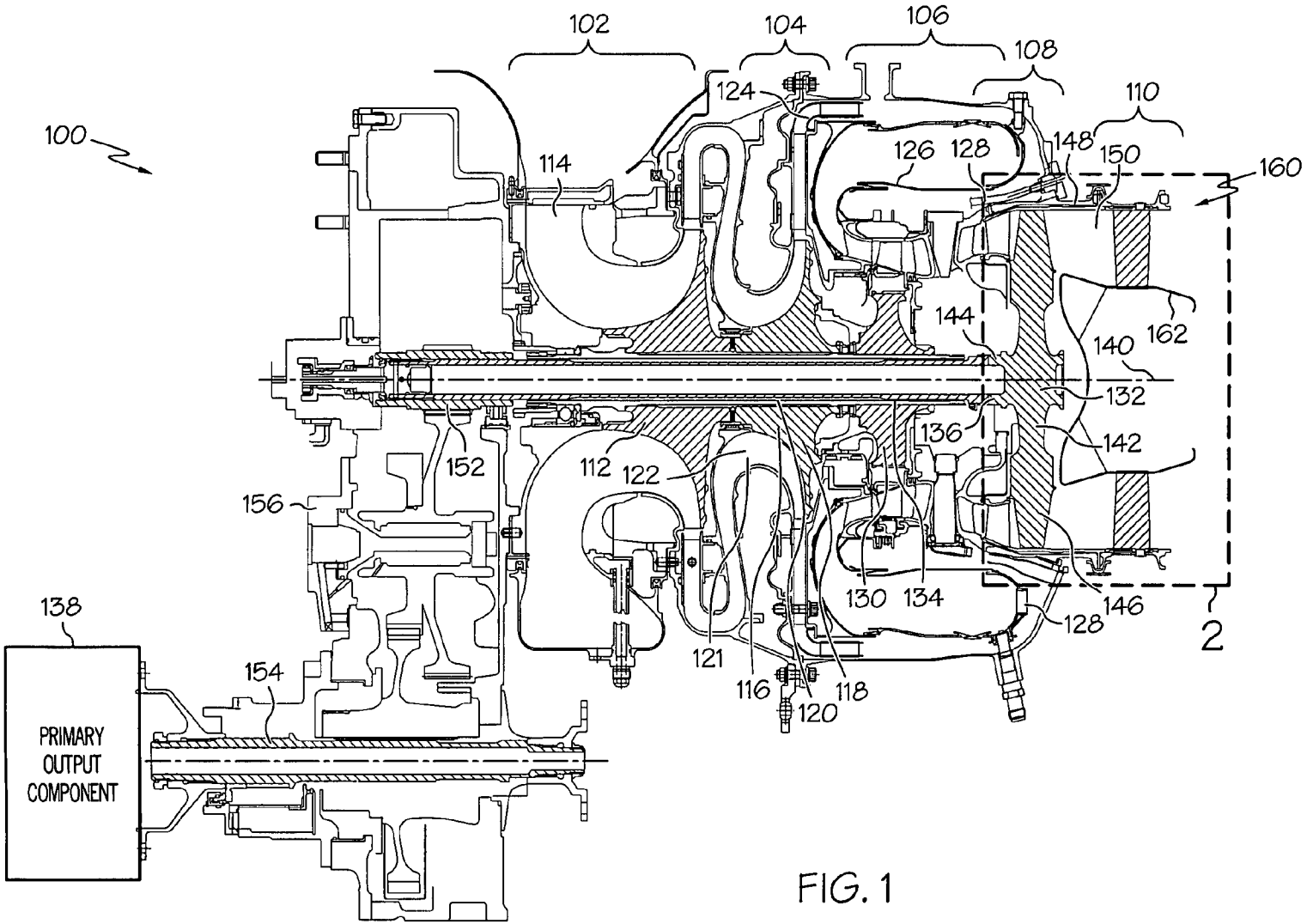
FIG. 1 is a simplified, cross-sectional view of an engine, according to an embodiment.

FIG. 1 is a simplified, cross-sectional view of an engine 100, according to an embodiment. The engine 100 is configured such that adjacent components of the engine 100 may have improved robustness over those of conventional engines during an overspeed condition. Although the engine 100 is illustrated as being a turboshaft turbine engine, the engine 100 may be another type of engine, such as a gas turbine engine, a a turbofan, turbojet, auxiliary power unit, and the like. In any case, the engine 100 may generally include an intake section 102, a compressor section 104, a combustor section 106, a turbine section 108, and an exhaust section 110. The intake section 102 draws air into an airflow inlet 114 and accelerates the air into the compressor section 104.

The compressor section 104 includes a compressor 116 that raises the pressure of the air directed into it from the intake section 102. As shown in FIG. 1, the compressor section 104 may be a two-stage compressor 112, 116. However, other types of compressors may alternatively be used. One or both of the compressors 112, 116 may include an impeller 118 that is mounted to a compressor shaft 120 and that is surrounded by a shroud 121 to define a compressor section flowpath 122. Although two compressors 112, 116 are shown, more compressors may be included in other embodiments. In an embodiment, the high pressure air may be directed into the combustor section 106 by a diffuser 124. The diffuser 124 may diffuse the high pressure air for more uniform distribution thereof into the combustor section 106. In an embodiment, the combustor section 106 may include an annular combustor 126, which receives the diffused air. One or more fuel nozzles 128 may supply fuel to the annular combustor 126, and the high pressure air is mixed with fuel and combusted therein. The combusted air is then directed into the turbine section 108.

The turbine section 108 may include an intermediate turbine 130 and a power turbine 132 disposed in axial flow series. The combusted air from the combustor section 106 expands through the turbines 130, 132 causing each to rotate. As each turbine 130, 132 rotates, each drives equipment in the engine 100 via concentrically disposed shafts or spools. For example, the intermediate turbine 130 may drive the compressor 116 via an intermediate shaft 134, which is coupled to the compressor shaft 120, in an embodiment. In another embodiment, the power turbine 132 includes a turbine rotor 136 that drives a primary output component 138, such as a propeller. In such case, the turbine rotor 136 may be adapted to rotate about a centerline 140 (e.g., engine centerline) and may include a hub 142 that is coupled to a turbine rotor shaft 144. The hub 142 may also include a plurality of turbine blades 146 extending radially outwardly. The turbine blades 146 may be surrounded by a portion of an engine case 148 to define a turbine section flowpath 150 through which the centerline 140 extends. The hub 142 and the turbine blades 146 act as a load upon which combusted air received by the turbine section flowpath 150 may provide a torque to rotate the turbine rotor shaft 144. The turbine rotor shaft 144 may be coupled to a main shaft 152 that, in turn, is coupled to a primary output shaft 154 to which the primary output component 138 is mounted. For example, a gearbox assembly 156 may couple the primary output shaft 154 and the main shaft 152 to each other.

Figure 2:
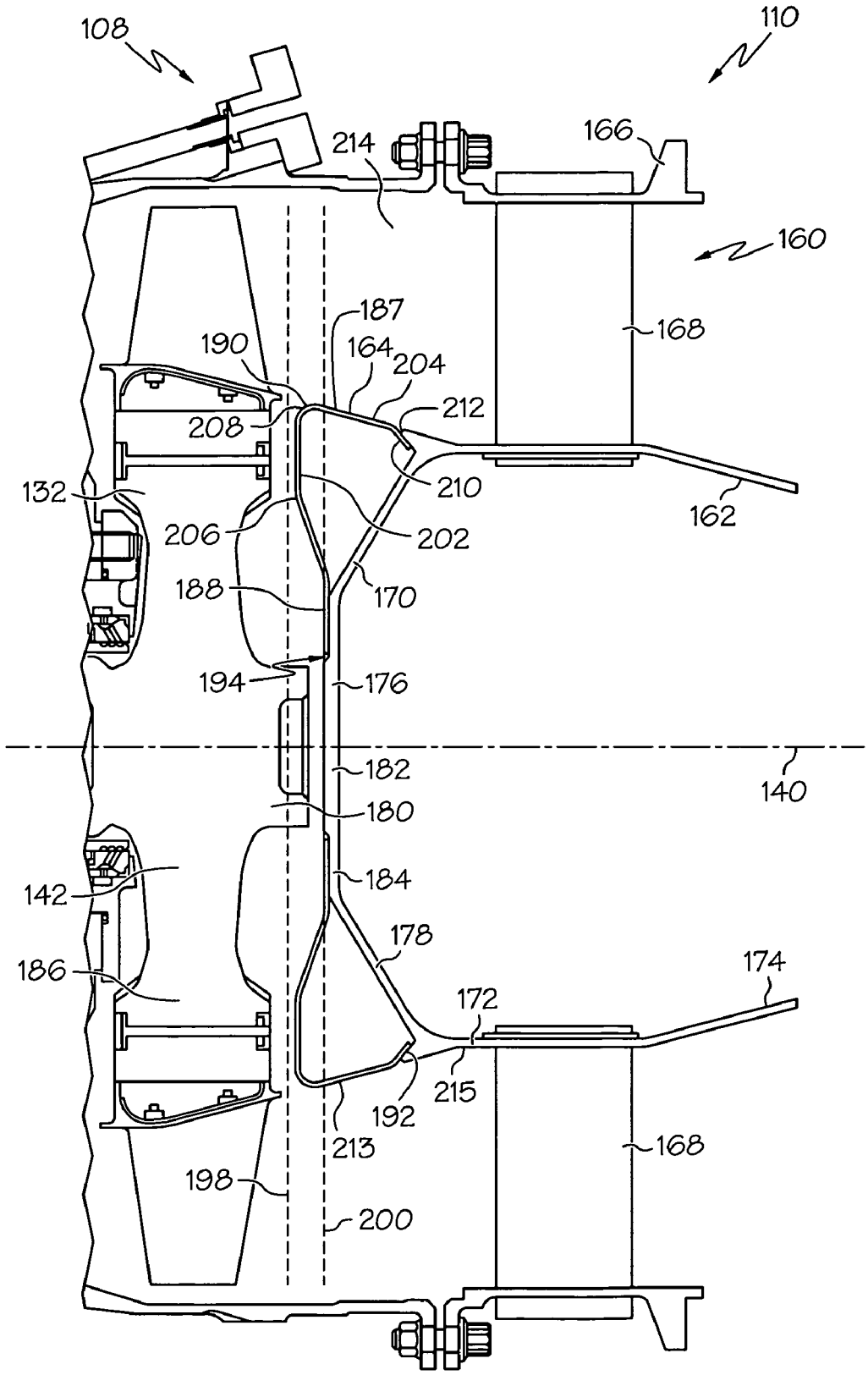
FIG. 2 is a close-up view of a section of the engine shown in FIG. 1 indicated by dotted box 1, according to an embodiment.

After the air travels through the turbine section 108, it is then exhausted through the exhaust section 110. FIG. 2 is a close-up view of a portion of the turbine section 108 (e.g., the power turbine 132) and the exhaust section 110 of the engine 100 as indicated by dotted box 1 shown in FIG. 1, according to an embodiment. In accordance with an embodiment, the exhaust section 110 may include an exit guide vane assembly 160. The exit guide vane assembly 160 is configured to direct the air in a desired direction and to serve as a retention structure for retaining the adjacent power turbine 132, in an unlikely event that the power turbine 132 moves axially aft. In this regard, the exit guide vane assembly 160 may include a center body 162, an energy absorber 164, an annular case 166, and a plurality of exit guide vanes 168, in an embodiment.

The center body 162 extends along the centerline 140 and is disposed adjacent to and downstream from the power turbine 132, in an embodiment. According to an embodiment, the center body 162 may comprise material capable of maintaining structural integrity when exposed to temperatures greater than about 600° C. Suitable materials include, but are not limited to nickel-based superalloys, Inconel 718, Waspalloy, Haynes 282, or other similar high-temperature alloys. In an embodiment, center body 162 comprises a single, unitary structure, as shown in FIG. 2. However, in other embodiments, the center body 162 may comprise several pieces that are welded, bolted or otherwise coupled together. In any event, the center body 162 includes an enclosed end 170, a midsection 172, and an open end 174, in an embodiment.

According to an embodiment, the enclosed end 170 may have a truncated cone shape, a concave-dish shape, or another suitable shape for including a contact section 176 and an angled section 178. The contact section 176 is disposed adjacent to the power turbine 132 and is adapted to limit axial movement of the power turbine 132 and to reduce a radial component and a torsional component of a load that may be applied to the contact section 176 by the rotating power turbine 132. In this regard, the contact section 176 provides a surface against which an inner radial section 180 of the power turbine hub 142 may abut. The contact section 176 may extend radially outwardly from the centerline 140 and may have a plate-like shape, in an embodiment. In an example, the contact section 176 may have a diameter in a range of from about 3 cm to about 5 cm. In other examples, the diameter of the contact section 176 may be greater or less than the aforementioned range.

In another embodiment, the contact section 176 may comprise an inner section 182 and an outer section 184. In such case, the inner section 182 and the outer section 184 may be adapted to provide a land for the energy absorber 164 to lie in while maintaining a flush interface surface with the power turbine 132 during contact therewith. In an embodiment, the inner section 182 may have a first thickness, and the outer section 184 may have a second thickness that is less than the first thickness. In another embodiment, the inner section 182 may comprise a first material, and the outer section 184 may comprise a second material that has a different strength capability than the first material. In still another embodiment, the inner and outer sections 182, 184 may comprise substantially similar materials or materials having similar strength capabilities and/or substantially similar thicknesses, except the inner section 182 may include a coating or layer (not shown) to improve its strength capability.

The angled section 178 extends away from and is angled relative to the contact section 176. The angled section 178 is adapted to avoid contact with the power turbine 132 in an event that the power turbine 132 becomes angled relative to the centerline 140. In particular, in an event that angular displacement of the power turbine 132 occurs, the angled section 178 supports the contact section 176 without providing a surface against which an outer radial section 186 of the power turbine hub 142 may abut. In an embodiment, the angled section 178 may have an annular plate shape. In other embodiments, the angled section 178 may include a plurality of flat plates, which may or may not be spaced circumferentially apart from each other and that radiate outwardly from the contact section 176. In any case, the limit of the angular displacement may depend on an angle a maximum predicted angular displacement of the turbine 132.

To maintain the structural integrity of the angled section 178 during application of a load by the power turbine 132, the angled section 178 may comprise substantially the same material as the contact section 176. In other embodiments, the angled section 178 may comprise a different material than the contact section 176, or may include a coating to improve strength. The angled section 178 may have an average thickness in a range of from about 0.15 cm to about 0.2 cm, in an embodiment. In other embodiments, the average thickness may be greater or less than the aforementioned range.

The energy absorber 164 is coupled to the center body 162 and disposed over the enclosed end 170 of the center body 162 to serve as a barrier between the outer radial section 186 of the power turbine hub 142 and the angled section 178 of the center body 162. In an example, the energy absorber 164 may be located adjacent to the contact section 176. In another embodiment, the energy absorber 164 may be disposed over a portion of the contact section 176 and the angled section 178.

According to an embodiment, the energy absorber 164 is configured to reduce energy that may be supplied by the rotational, axial, and/or torsional motion of the rotating power turbine 132. In this regard, the energy absorber 164 is adapted to collapse, if the power turbine 132 applies a first threshold load to the energy absorber 164. For example, the energy absorber 164 may comprise a baffle or a similar type of structure configured to be capable of collapsing. In other examples, the energy absorber 164 is also configured to be capable of detaching (e.g., ripping away), when the rotating power turbine 132 supplies a load having a magnitude that exceeds a second threshold torsional load magnitude. In any case, the energy absorber 164 may comprise a sheet of the material having a desired contour, and the sheet of material may have a thickness in a range of from about 0.05 cm to about 0.1 cm. In other embodiments, the thickness of the sheet of material may be greater or less than the aforementioned range. Suitable materials from which the energy absorber 164 may comprise include, but are not limited to, nickel-base alloys, Hastelloy X, Inconel 625, and the like.

In another embodiment, the contour of the energy absorber 164 may be defined by an attachment section 188, a bumper section 190, and a center body interface 192. The attachment section 188 is attached to the center body 162. In an embodiment, the attachment section 188 is coupled to the contact section 176 of the center body 162. In one example, the attachment section 188 includes an opening 194 for engaging the contact section 176. The opening 194 may have a diameter that is larger than that of the contact section 176 and in a range of from about 4 cm to about 6 cm, in an embodiment. In other embodiments, the diameter may be greater or less than the aforementioned range. In still other embodiments, the diameter of the opening 194 may be substantially equal to the diameter of the contact section 176. In accordance with another embodiment, the attachment section 188 may not include an opening and instead, may include a well for engaging the contact section 176 or may be a flat surface that is disposed over the contact section 176. In any case, the attachment section 188 is fixedly attached to at least a portion of the contact section 176. According to an embodiment, the attachment section 188 is welded to the contact section 176. In an embodiment, a substantial entirety of the attachment section 188 may be welded to the contact section 176. In another embodiment, the attachment section 188 may be intermittently welded to the contact section 176. In such case, the intermittent weld may or may not be substantially uniformly spaced around a circumference of the attachment section 188.

The bumper section 190 extends radially outwardly from the inner plate section 192. In an embodiment, the bumper section 190 is configured to extend axially away from the contact section 176 of the center body 162 and may be configured to extend toward the power turbine 132 and may have an impact surface that is positioned at a first axial location (indicated by dotted line 198) that is closer to the power turbine 132 than a second axial location (indicated by dotted line 200) at which the contact section 176 is disposed. The bumper section 190 may be spaced apart from the angled section 178 of the center body 162 to form a buffer cavity 208 into which the bumper section 190 may collapse, if the outer periphery of the power turbine 132 exerts the first threshold load against the bumper section 190. According to an embodiment, a length between the first and second axial locations 198, 200 may be in a range of from about 0.5 cm to about 0.7 cm. In other embodiments, the length between the first and second axial locations 198, 200 may depend on a distance desired between the bumper section 190 and the outer radial section 186 of the power turbine hub 142 and/or on a particular material strength of the bumper section 190.

In an embodiment, the bumper section 190 may have a radial section 202 and an axial section 204. The radial section 202 may extend from an edge 206 of the attachment section 188 at an angle relative to the contact section 176 of the center body 162. For example, the radial section 202 and the contact section 176 may form an angle in a range of between about 15° to about 25°. In other embodiments, the angle may be greater or less than the aforementioned range. The radial section 202 may have an average radial length (measured between the edge 200 of the attachment section 188 and an outer peripheral edge 208 of the energy absorber 178) in a range of from about 3 cm to about 4 cm, in an embodiment. In another embodiment, the average radial length may be greater or less than the aforementioned range. The axial section 204 may extend from the outer peripheral edge 208 to the midsection 172 of the center body 162. In this regard, an angle formed between the radial section 202 and the axial section 204 and a length of the axial section 204 may depend on a location of the midsection 172 relative to the axial section 204. In an example, the angle may be in a range of from about 10° to about 20°, and the length may be in a range of from about 1.5 cm to about 2.5 cm. In other embodiments, the angles and length may be greater or less than the aforementioned ranges.

The center body interface 192 may be configured to allow the bumper section 190 to be moved axially relative to the center body 162, in an embodiment. For example, the center body interface 192 may comprise an end 210 of the axial section 204 of the bumper section 190 and an overhang 212 that extends axially from the midsection 172 of the center body 162. The overhang 212 may be a single ring-shaped piece that extends from the center body 162. In another embodiment, the overhang 212 may comprise two or more pieces that are coupled to the center body 162 and arranged in a ring. According to an embodiment, the overhang 212 has a diameter that is slighter larger than a diameter of the end 210 of the axial section 204. In an embodiment, the diameter of the overhang 212 may be in a range of from about 13 cm to about 14 cm, and the diameter of the end 210 of the axial section 204 may be in a range of from about 13 cm to about 14 cm. In other embodiments, the diameters may be greater or smaller than the aforementioned ranges.

The center body interface 192 may be a temporarily rigid interface, in an embodiment. For example, the overhang 212 and the end 210 may be intermittently welded to each or may be spot welded to maintain positioning relative to each other before a threshold load is applied to the energy absorber 164. In another embodiment, the center body interface 192 may be configured such that the end 210 of the bumper section axial section 204 and the overhang 212 of the midsection 172 may move axially relative to each other, either due to thermal expansion of the components or due to a supply of an axial load by the power turbine 132. In such case, the end 210 of the bumper section axial section 204 may be configured to form a slip fit with the overhang 212 of the midsection 172. The energy absorber 164 is further adapted to have an outer surface 213 that defines a first portion of the exhaust section flowpath 214, in an embodiment. According to an embodiment, the outer surface 187 of the energy absorber 164 is contoured to direct the air to an outer surface 215 of the midsection 172 of the center body 162, which forms a second portion of the exhaust section flowpath 214.

To turn the air flow through the exhaust section flowpath 214 in a manner by which to remove a tangential swirl component from the airflow such that the air flows along the centerline 140, the plurality of exit guide vanes 168 are disposed in the exhaust section flowpath 214. Specifically, the exit guide vanes 168 may extend between the centerbody 162 and the annular case 166. In an embodiment, the exit guide vanes 168 may be formed from material capable of maintaining structural integrity when exposed to temperatures greater than about 600° C. Suitable materials include, but are not limited to Inconel 718, Waspalloy, Haynes 282, or other similar high-temperature alloys.

Figure 3:
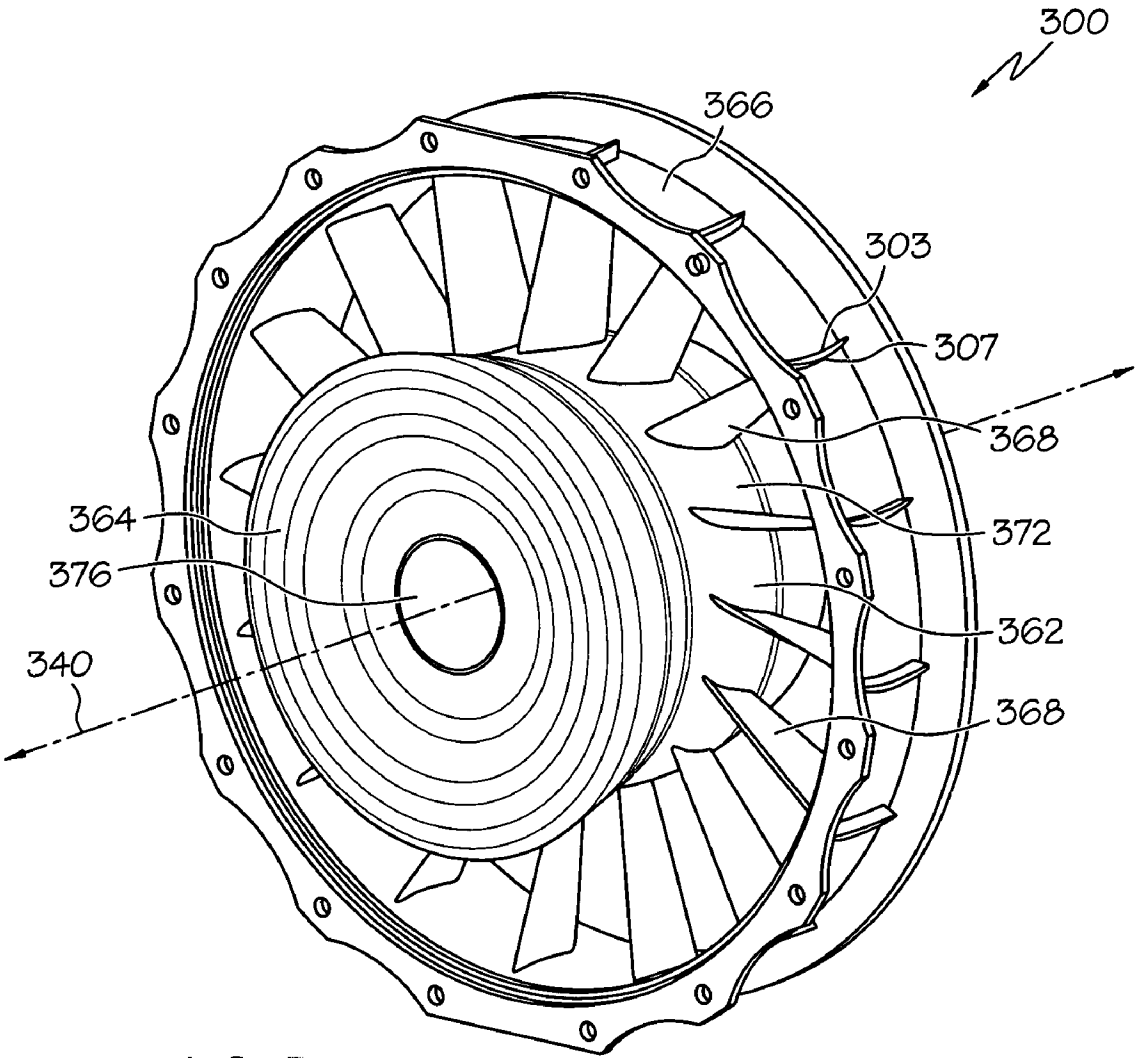
FIG. 3 is a perspective view of a vane assembly from a forward view looking aft, according to an embodiment.
Figure 4:
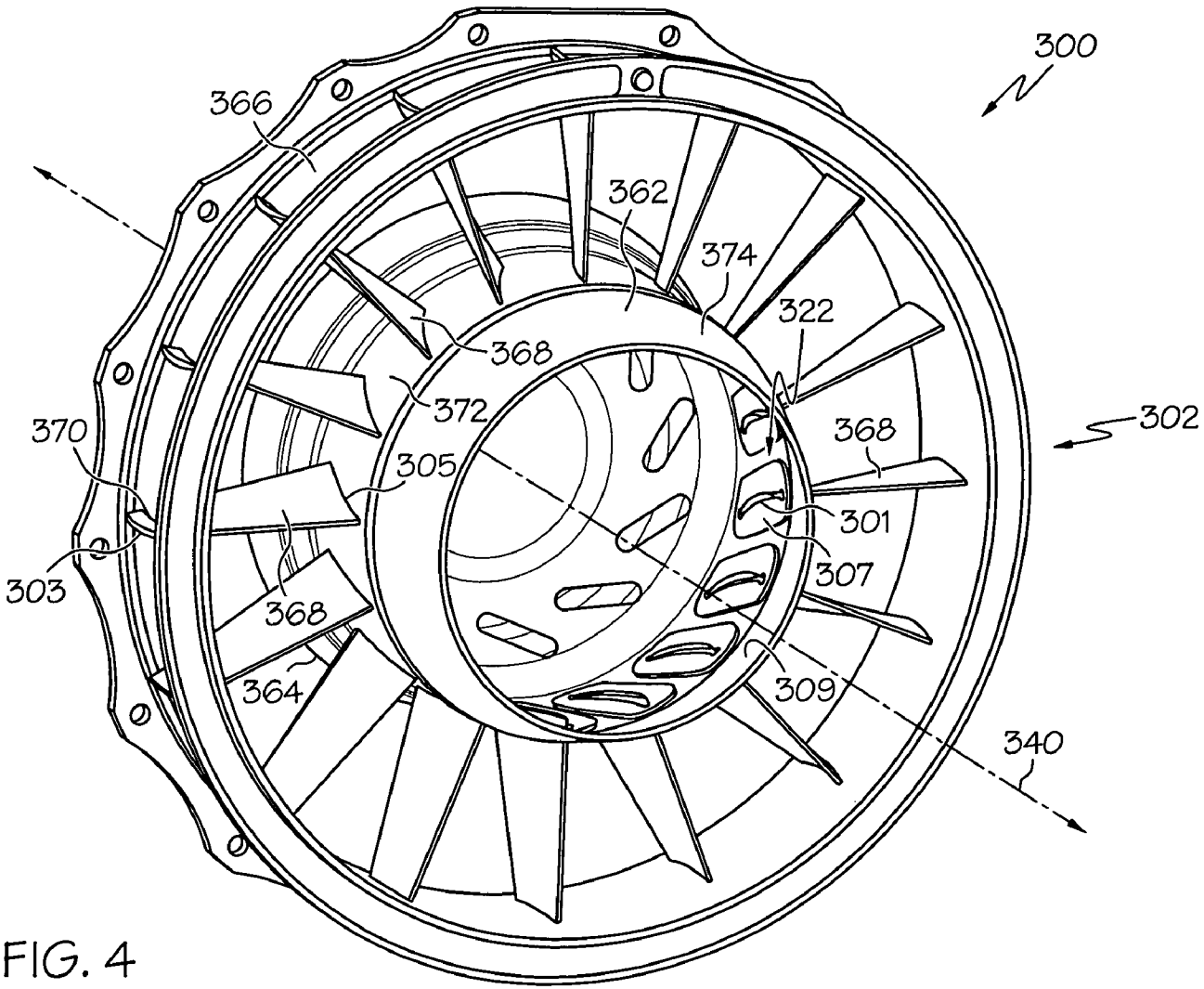
FIG. 4 is a perspective view of the vane assembly shown in FIG. 3 from an aft view looking forward, according to an embodiment.

FIG. 3 is a perspective view of an exit guide vane assembly 300 from a forward view looking aft, and FIG. 4 is a perspective view of the vane assembly 300 shown in FIG. 3 from an aft view looking forward, according to an embodiment. The exit guide vane assembly 300 includes a center body 362, an energy absorber 364, an annular case 366, and a plurality of exit guide vane 368. Each of the center body 362, the energy absorber 364, and the plurality of exit guide vanes 368 are configured substantially similar to center body 162, energy absorber 164, and exit guide vanes 168 described above.

The annular case 366 is disposed around a midsection 372 of the center body 362. According to an embodiment, the annular case 366 may be formed from material capable of maintaining structural integrity when exposed to temperatures greater than about 600° C. Suitable materials include, but are not limited to Inconel 718, Hastelloy X, Haynes 282, or other similar high-temperature alloys. In an embodiment, the annular case 366 has an axial length that is substantially less than an axial length of the center body 362. For example, the axial length of the annular case 366 may be in a range of from about 5 cm to about 6 cm, while the axial length of the center body 362 (measured from a contact section 376 to an end 374 of the center body 362) may be in a range of from about 9.5 cm to about 10.5 cm. Alternatively, the axial lengths may be greater or less than the aforementioned ranges. In another embodiment, the annular case 366 may have an inner diameter in a range of from about 23 cm to about 24 cm and/or an outer diameter in a range of from about 26 cm to about 27 cm. In still other embodiments, the diameters may be greater or less than the aforementioned ranges.

The plurality of exit guide vanes 368 are disposed circumferentially around the midsection 372 and extend between the center body 362 and the annular case 366. In an embodiment, the exit guide vanes 368 are substantially uniformly spaced around a circumference of the midsection 372. In another embodiment, the exit guide vane 368 may be staggered in a patterned or random fashion around the circumference of the midsection 372. Although sixteen exit guide vanes 368 are shown in FIGS. 3 and 4, more or fewer vanes may be included in other embodiments.

To further allow the exit guide vane assembly 300 to absorb energy if a torque is applied against the exit guide vane assembly 300, at least some of the guide vanes 368 are attached such that the center body 362 can twist or can be rotated relative to the annular case 366. With particular reference to FIG. 4, in this regard, ends of selected ones of the plurality of guide vanes 368 (i.e., a first end 301 and a second end 303 of the guide vane 368) may be coupled to the center body 362 and the annular case 366 in a particular manner. For example, one guide vane 368 may be attached in the particular manner. In another example, uniformly spaced, selected guide vanes of the plurality of the guide vanes 368 (but less than all) may be attached in the particular manner. In yet other embodiments, all of the guide vanes 368 are attached in the particular manner. In each case, an engagement interface 322 may be employed to retain the first end 301 of the guide vane 368 radially inward relative to the center body 362, in an embodiment. For example, the engagement interface 322 may include a slot 305 formed at a desired location through the center body 362 and a collar 307.

In an embodiment, the slot 305 may be formed such that it extends axially along the center body midsection 372. The slot 305 may or may not be parallel with a centerline 340, in an embodiment, depending on a direction in which airflow is desired. In another embodiment, the dimensions and shape of the slot 305 may depend on a particular axial cross-sectional shape of the guide vane 368. Thus, for example, the slot 305 may have a curve shape, if the guide vane 368 has a curved axial cross-sectional shape. According to an embodiment, the slot 305 is dimensioned larger than at least a portion of the guide vane 368 so that guide vane 368 can extend through the slot 305. In any case, the slot 305 may have an axial length in a range of about 2 cm to about 3 cm and a width in a range of from about 0.05 cm to about 0.1 cm, in an embodiment. In another embodiment, the axial length and/or the width may be longer or wider than the aforementioned ranges.

The collar 307 is disposed over an inner surface 309 of the center body 362 and is attached to the first end 301 of the guide vane 368. The collar 307 is adapted to retain the first end 301 of the guide vane 368 at a position located radially inwardly relative to the center body 362 and thus, the collar 307 may be dimensioned larger than the slot 305. In an embodiment, the collar 307 may have an axial length in a range of about 3 cm to about 4 cm, a width in a range of from about 1.5 cm to about 2.0 cm, and a thickness in a range of from about 0.08 cm to about 0.13 cm. In another embodiment, the axial length, width, and/or the thickness may be greater or less than the aforementioned ranges.

The collar 307 comprises material capable of maintaining structural integrity when exposed to temperatures greater than about 600° C. Suitable materials include, but are not limited to Inconel 718, Inconel 625, Hastelloy X or other similar high-temperature alloys. According to an embodiment, the collar 307 may be welded to the guide vane 368. In another embodiment, the collar 307 may include a slit (not shown) for engaging the first end 301 of the guide vane 368, and an epoxy, weld or another manner of fastening and/or adhering the guide vane 368 to the collar 307 may be employed in conjunction with the slit. Although the collar 307 is shown as having a generally rectangular shape, any other shape allowing the collar 307 to be dimensioned larger than the slot 305 may alternatively be employed.

The second end 303 of the guide vane 368 may be fixedly attached to the annular case 366, in an embodiment. According to an embodiment, the second end 303 of the guide vane 368 is fixedly attached (e.g., welded, adhered or the like) to the inner surface of the annular case 366. In another embodiment, the annular case 366 includes a plurality of slots 370 corresponding to the number of guide vanes 368, each guide vane 368 extends through a corresponding slot 370, and the second end 303 of the guide vane 368 may be disposed radially outward relative to the annular case 366. The slot 370 may be configured and dimensioned substantially similarly to a cross section of the guide vane 368. For example, the slot 370 may have a length and width that is substantially equal or slightly larger than the axial cross section of the guide vane 368. In such an embodiment, the guide vane 368 may be welded, adhered, or otherwise fixedly attached to the annular case 366.

Although the engagement interface 322 is described above as being located on the center body 362 and the second end 303 of the guide vane 368 is described as being fixedly attached to the annular case 366, other embodiments may include a different configuration. For instance, the engagement interface may be included on the annular case 366, in another embodiment. In such case, the second end 303 of the guide vane 368 and the collar 307 (which may be attached to the second end 303 of the guide vane 368) may be positioned radially outwardly relative to the annular case 366. Additionally, the first end 301 of the guide vane 368 may or may not be fixedly attached to the center body 362. For example, the guide vane 368 may extend through the slot 305 so that the first end 301 of the guide vane 368 may simply be positioned radially inwardly from the center body 362. Alternatively, the guide vane 368 may be additionally welded, adhered, or otherwise attached to the center body 362.

Referring back to FIG. 1, during engine operation, the power turbine 132 is configured to rotate relative to the centerline 140 at particular operating speeds. In some cases, such as during testing, the power turbine 132 may rotate at speeds that exceed a maximum operating speed and may become displaced axially, in some instances. In these cases, the energy absorber 164 serves as a barrier between the rotating power turbine 132 and the exit guide vane assembly 160 and minimizes damage that may occur to components surrounding the power turbine 132.

In particular, when the power turbine 132 is rotating and contacts the contact section 176 of the center body 162, the power turbine 132 applies a load against the center body 162. As the power turbine 132 rides against the contact section 176, the radial and torsional components of the applied load reduce. In some cases, the power turbine 132 may experience an angular displacement relative to the centerline 140 and may tilt toward and contact the bumper section 190. The axial load applied by the power turbine 132 to the bumper section 190 causes the bumper section 190 to move axially. In an embodiment in which the energy absorber 164 is slip fit with the center body 162 and when the axial load applied is below a threshold axial load magnitude, the energy absorber 164 slides axially toward the center body 162 to absorb and to reduce the applied axial load. When the axial load applied by the power turbine 132 exceeds the threshold axial load magnitude, the bumper section 190 collapses to further reduce the load applied by the power turbine 132. In some cases, the torsional load applied by the power turbine 132 exceeds a threshold torsional load magnitude. The power turbine 132 may temporarily attach to the bumper section 190, and because the power turbine 132 is rotating, the bumper section 190 may detach from the center body 162. In other cases, the bumper section 190 may not detach from the center body 162 and, instead, the power turbine 132 and the center body 162 may temporarily attach to each other via the energy absorber 164. In such case, the rotation of the power turbine 132 may cause the center body 162 to twist relative to the centerline 140. Because at least some of the vanes 168 are not fixedly attached to the annular case 166 and/or the center body 162, the center body 162 is allowed to rotate relative to the centerline 140 while the annular case 166 remains stationary and the guide vanes 168 act as a brake to prevent the center body 162 from twisting beyond a predetermined magnitude relative to the annular case 166. As a result, the torsional load of the power turbine 132 is reduced.

Exit guide vane assemblies and energy absorbers have been described that may prevent damage to adjacent components during power turbine positional displacement. Specifically, the exit guide vane assemblies and the energy absorbers may provide a secondary axial support structure to contain a power turbine within an engine. By including a contact section on the exit guide vane assemblies, radial and torsional components of a load applied by a rotating power turbine may be reduced. Additionally, inclusion of the energy absorbers can further reduce the torsional and axial components of the applied load. Moreover, by attaching the vanes such that at least some of the vanes are not fixedly attached to an annular case and/or a center body, the center body may be allowed to rotate relative to the annular case to allow the vanes to torque relative to a centerline. In this way, the torsional component of the applied load may be reduced further. In addition, the outer surfaces of the center body and the energy absorber configured as described above define an aerodynamic flowpath along with air may flow out the exhaust section of the engine. In addition, it is desirable for the structure or apparatus to be capable of being retrofitted into existing turbine engines and to be relatively simple and inexpensive to manufacture.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A retention structure for retaining an adjacent turbine, the turbine capable of rotating about a centerline, the retention structure comprising:

a center body extending along the centerline and including an outer surface, an enclosed end, an open end, and a contact section, the outer surface adapted to define a first portion of a flowpath, and the contact section extending radially outwardly from the centerline and located on the enclosed end of the center body, the contact section configured to reduce a radial component and a torsional component of a first load that exceeds a first threshold applied to the contact section, when the turbine rotates and contacts the contact section and applies the first load to the contact section; and an energy absorber coupled to the center body and disposed adjacent to the contact section, the energy absorber having an outer surface adapted to define a second portion of the flowpath, the energy absorber further adapted to collapse, when the turbine rotates and contacts the energy absorber and applies a second load that exceeds a second threshold to the energy absorber.

2. The retention structure of claim 1, wherein at least a portion of the energy absorber is adapted to detach, when a torsional component of the second load exceeds a threshold torsional load.

3. The retention structure of claim 1, wherein:

the energy absorber has an attachment section and an engagement section, the attachment section is rigidly attached to and extends radially outwardly relative to the center body, and the engagement section is adapted to form a slip joint with the center body to allow the energy absorber to move axially relative to the center body.

4. The retention structure of claim 1, wherein the center body includes a midsection extending between the enclosed end and the open end, and the retention structure further comprises an angled section forming a portion of the enclosed end and angled relative to the contact section, the angled section extending from the contact section to the midsection, and the energy absorber spaced apart from the angled section to form a buffer cavity.

5. The retention structure of claim 1, wherein the energy absorber comprises a bumper section including a radial section and an axial section, the radial section extending radially outwardly relative to the contact section of the center body, and the axial section angled relative to the radial section and disposed around the angled section of the center body to extend toward the center body.

6. The retention structure of claim 5, wherein the energy absorber further comprises an attachment section located radially inwardly from the radial section of the bumper section, the attachment section welded to the contact section of the center body.

7. The retention structure of claim 1, wherein the energy absorber includes an attachment section and an engagement surface, the attachment section is coupled to the contact section of the center body, and the engagement surface is intermittently welded to the center body.

8. The retention structure of claim 1, wherein the energy absorber includes an attachment section and an engagement surface, the attachment section is coupled to the contact section of the center body, and the engagement surface is disposed radially inwardly relative to an overhang extending from the center body to form a slip fit with the overhang.

9. The retention structure of claim 1, further comprising:

an annular case disposed around the center body; and a plurality of vanes extending between the annular case and the center body.

10. The retention structure of claim 9, further comprising:

an engagement interface adapted to retain a first end of a vane of the plurality of vanes radially inwardly relative to the center body to thereby allow the center body to twist relative to the annular case, when the turbine applies a third load having a torsional component to the center body.

11. The retention structure of claim 9, further comprising:

a collar disposed over an inner surface of the center body, wherein a first vane of the plurality of vanes has a first end and a second end, the first end of the first vane extends through a slot in the center body and is attached to the collar, and the second end of the first vane is attached to the annular case.

12. The retention structure of claim 11, wherein the second end of the first vane is welded to the annular case.

13. The retention structure of claim 11, wherein the second end of the first vane is not welded to the annular case.

14. An exit guide vane assembly comprising:

a center body extending along a centerline and including an enclosed end, an open end, and a midsection, the enclosed end defined by a contact section and an angled section, the contact section extending radially outwardly relative to the centerline, and the angled section angled relative to the contact section and extending from the contact section to the midsection;

a baffle disposed around the enclosed end of the center body, the baffle including a radial section and an axial section, the radial section extending radially outwardly and being angled relative to the contact section of the center body, and the axial section angled relative to the radial section and disposed around the angled section of the center body to extend toward the center body;

an annular case disposed radially outwardly relative to the center body; and a plurality of vanes extending between the center body and the annular case, wherein:

the baffle is configured to collapse, when an adjacent rotating turbine applies a first load that exceeds a first threshold against the baffle, and the center body is configured to reduce a radial component and a torsional component of a second load that exceeds a second threshold, when the adjacent rotating turbine applies the second load against the contact section of the center body.

15. The exit guide vane assembly of claim 14, wherein the radial section of the baffle has an inner section that is welded to the contact section of the center body.

16. The exit guide vane assembly of claim 14, wherein the center body includes an overhang extending from the center body and the axial section of the baffle includes an engagement surface that is slip fit with the projection.

17. The exit guide vane assembly of claim 14, further comprising:

a collar disposed on an inner surface of the mid-section, and wherein:

the mid-section includes a first slot, a first vane of the plurality of vanes extends through the first slot and has a first end and a second end, the first end is attached to the first collar, and the second end attached to the annular case.

18. The guide vane assembly of claim 17, wherein the second end of the first vane is welded to the annular case.

* * * * *